US005439013A

United States Patent [19]

Hoover

[11] Patent Number: 5,439,013

[45] Date of Patent: Aug. 8, 1995

[54] MANICURING DEVICE

[76] Inventor: Ursula Hoover, P.O. Box 794, Carmel, Ind. 46032

[21] Appl. No.: 95,659

[22] Filed: Jul. 21, 1993

[51] Int. Cl.[6] ..... A45D 29/02

[52] U.S. Cl. ..... 132/76.5; 132/76.4; 451/557

[58] Field of Search ..... 132/73, 73.5, 75.6, 132/76.4, 76.5; 451/540, 541, 557

[56] References Cited

U.S. PATENT DOCUMENTS

| | | | |
|---|---|---|---|
| 1,040,446 | 10/1912 | Smith | 132/75.6 |
| 1,335,777 | 4/1920 | Zelaya | 132/76.4 |
| 1,427,503 | 8/1922 | Wake | 132/76.4 |
| 1,856,854 | 5/1932 | Schwanhausser . | |
| 1,969,874 | 8/1934 | Butterfield . | |
| 2,075,932 | 4/1937 | Ehrmann . | |
| 2,110,999 | 3/1938 | Miga | 132/73.5 |
| 2,336,779 | 12/1943 | Creasy | 132/73.5 |
| 2,472,667 | 6/1949 | Lesserd | 132/75.6 |
| 4,381,792 | 5/1983 | Busch et al. | 132/76.4 |
| 4,930,529 | 6/1990 | Whitney | 132/76.5 |
| 5,163,455 | 11/1992 | Pointe et al. | 132/76.4 |
| 5,195,278 | 3/1993 | Grove . | |

FOREIGN PATENT DOCUMENTS

| | | | |
|---|---|---|---|
| 681793 | 2/1930 | France | 132/76.4 |

*Primary Examiner*—John G. Weiss
*Attorney, Agent, or Firm*—Locke Reynolds

[57] ABSTRACT

A manicuring device includes an elongated handle having a longitudinal axis. A disposable and replaceable element is co-axially and removably situated on at least one end of the handle and coupled to the handle so as to inhibit rotation of each replaceable element relative to the handle. Each replaceable element is formed to include an inner surface for engaging the handle, a generally cylindrical outer surface incorporating an abrasive of a selected grade, and a diagonal end surface substantially free of any abrasive which can be color coordinated to indicate the grade of the abrasive.

18 Claims, 1 Drawing Sheet

MANICURING DEVICE

BACKGROUND OF THE INVENTION

The present invention relates to devices used in the care of fingernails and particularly relates to hand operated abrading and polishing devices adapted for use to remove and or blend the free end of a natural nail under an artificial nail.

Artificial nails are commonly available on the market for application to enhance the appearance of the wearer's fingernails. The artificial nails are typically applied by a manicurist by coating the top surface of the natural nail with an adhesive or similar bonding agent. The artificial nail is then placed in contact with the bonding agent until the artificial nail is secured in position. The forward edge of the artificial nail is then filed to achieve the desired appearance. Usually, the artificial nail is thereafter subjected to one or more coats of liquid polish and protectants to achieve the final appearance.

Once the artificial nail has been bonded to the natural nail, it is generally desirable that the forward edge of the natural nail be filed so that any abrupt change in thickness is eliminated thereby diminishing the likelihood of any accumulation of unwanted material. If the abrupt change in thickness is not removed, foreign matter including bacteria and fungus can accumulate which can cause health problems as well as contribute to an unsightly appearance at the junction of the forward edge of the natural nail. This junction is, by its very nature, a part of a concave surface on the underside of the artificial nail. Such a concave surface is difficult, if not impossible, to file or burnish using a conventional flat nail file or emery board.

Some professional manicurists have employed power driven wheels to grind this junction. While such power driven wheels accomplish this task fairly quickly, the speed of the wheel used during the grinding process often generates sufficient heat through friction to cause some discomfort. Further, the abrasive wheel often contacts not only the underside of the natural nail, but also contacts the end of the finger in such a manner to remove some surface portion of the skin at the end of the finger thus making the ends of the finger unduly sensitive.

Thus, an object of the invention is to provide a hand operated rather than power operated manicuring device which can abrade and burnish the free end of a natural nail under an artificial nail while avoiding any discomfort to the person receiving the manicure.

SUMMARY OF THE INVENTION

A manicuring device in accordance with the present invention comprises an elongated handle similar in size and shape to a pencil or pen. A replaceable and disposable element is removably situated on at least one end of the handle. Each replaceable element has a generally cylindrical outer surface incorporating an abrasive and a diagonal end surface substantially free from any abrasive. Coupling means couples the replaceable element to the handle in such a manner as to inhibit any rotation of the replaceable element relative to the handle during use of the device.

The elongated handle is preferably generally linear and has a diameter of between about 3 mm and 3 cm. Preferably the diameter of the handle is about 1 cm while the length of the handle is between about 5 and 20 cm. The replaceable element preferably comprises a body having an inner surface for engaging the coupling means on the elongated handle. The replaceable element also has a generally cylindrical outer surface of a diameter about equal to that of the handle and has a length of between about 1 and 2 cm. The outer cylindrical surface defines a substrate to which a graded particulate abrasive of substantially uniform particle size is adhesively bonded or otherwise secured. The replaceable element preferably comprises a molded plastic such as low density polyethylene having a color selected to indicate the particle size of the graded particulate abrasive. The diagonal end surface of the replaceable element is preferably inclined at an angle of between about 15° and 45° relative to a longitudinal axis of the handle. The handle longitudinal axis is generally co-axial with an axis of rotation of the cylindrical surface of the replaceable element.

The coupling means which inhibits the rotation of the replaceable element relative to the handle during use can take the form of a deformable thread on the inner surface of the replaceable element which is engaged by a threaded portion at the end of the handle. Alternatively, the coupling means can comprise a plurality of elongated grooves and lands incorporated into the surface of the handle end which engage either a grooved or a deformable inner surface on the replaceable element and allow the replaceable element to simply be plugged onto the handle.

One feature of the present invention is the use of replaceable elements mounted to a handle with a coupling means which inhibits rotation of the replaceable element relative to the handle. This feature permits the application of substantial force and torque to the handle to achieve a quick removal of the desired portion of the free end of the nail while avoiding any burning which can occur with power operated wheel abrasives.

Another feature of the present invention is the incorporation of a diagonal non-abrasive surface on an end of the replaceable elements. This diagonal non-abrasive surface permits the burnishing and polishing of the underside of the nail with the cylindrical outer surface of the replaceable element while at the same time protecting the end of the finger from any contact with the abrasive thereby achieving a more comfortable removal of the free end of the natural nail from under the artificial nail.

Yet another feature of the present invention is the use of replaceable elements which are color coded in coordination with the average size of the abrasive which is incorporated on the outside cylindrical surface of the replaceable elements. Such replaceable elements can be manufactured at very low cost and are easily identified by the consumer, whether the invention is used at home or by a professional in a salon. The very low cost of the replaceable elements ensures their disposal between manicures thereby reducing the possibility of transmission of bacteria or fungus from one person to another.

Other features and advantages of the present invention will become apparent to those skilled in the art upon consideration of the following description of a preferred embodiment illustrating the best mode as presently contemplated by the inventor.

DESCRIPTION OF THE PREFERRED EMBODIMENT

Figure 1:
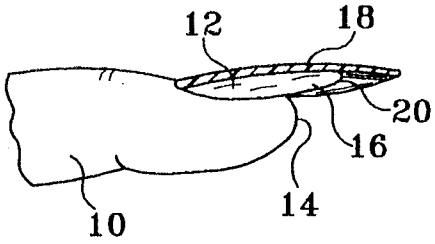
FIG. 1 is a diagrammatic view of a fingertip showing an artificial nail in section installed over the top of a natural nail.

FIG. 1 shows the tip of a finger 10 including a natural nail 12 having a portion 16 which extends beyond the end 14 of the finger 10. The extended portion 16 of the nail underlies an artificial nail 18, shown in section, which has been adhesively secured to the top of nail 12. The forward margin 20 of the extended portion 16 of the natural nail 12 forms a ridge under the artificial nail which can attract dirt, bacteria and fungus which can detrimentally affect the overall health and appearance of the nail. Thus, it is common practice to file or otherwise abrade the extended portion 16 of nail 12 to form a smooth transition devoid of the abrupt ridge 20.

Figure 2:
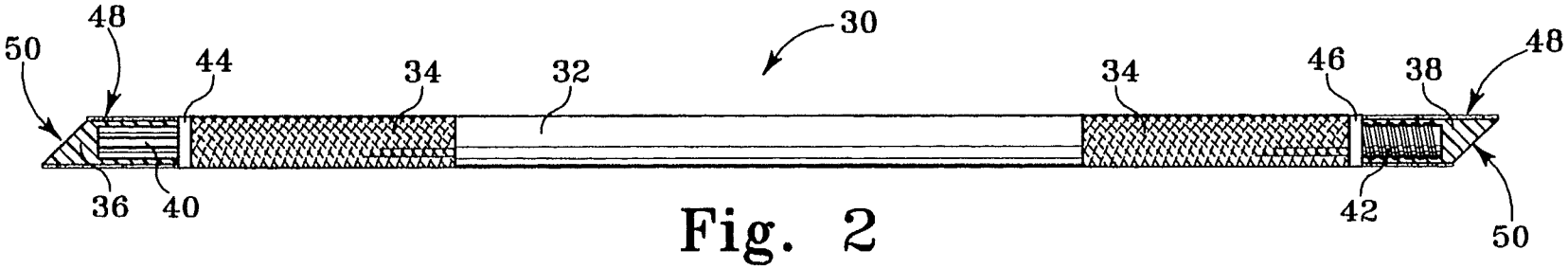
FIG. 2 is a side elevation view of a manicure device in accordance with the present invention with the replaceable elements shown in section.

FIG. 2 shows a manicuring device 30 in accordance with the present invention. The device 30 comprises an elongated handle 32 which may be constructed of any sturdy material which is resistant to any significant deflection or breakage such as plastic or metal. The handle 32 preferably includes surface feature means 34 such as grooves or notches which enhance the ability to manipulate the device 10. The particular appearance and make up of the surface features 34 is largely one of style as long as it functionally facilitates the need to apply through the handle necessary forces and torque required to file or burnish the extended portion 16 of nail 12.

The device 30 further includes disposable and replaceable elements 36 and 38 on opposite ends of handle 32. Coupling means 40 and 42 couple the replaceable elements 36 and 38 respectively to the handle 32 in such a manner as to inhibit any rotation of the replaceable elements relative to the handle during the abrading process. The coupling means 40 is shown to comprise elongated grooves and lands which can be incorporated into the surface of the end 44 of handle 32 which allows the replaceable element to simply be plugged onto the handle. Alternatively, the coupling means 42 can be in the form of displaceable threads which secure the element 38 to end 46 of handle 32.

The replaceable elements 36 and 38 are generally in the form of a cylindrical body having an outer surface which defines a cylindrical substrate 48 incorporating a particulate abrasive. The replaceable elements 36 and 38 further have a diagonal end surface 50 which is substantially free of any abrasive.

Figure 3:
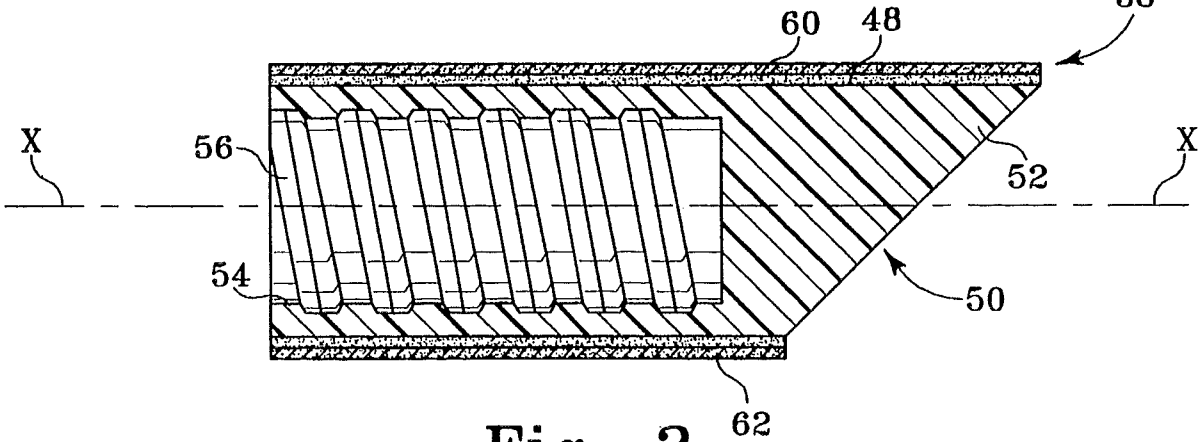
FIG. 3 is an enlarged sectional view of a replaceable element having an abrasive outer surface in accordance with the present invention.

FIG. 3 shows the replaceable element 38 in more detail to comprise a plastic body 52 having an inner surface 54 which is molded to incorporate a spiral thread 56. The material selected for molding the plastic body 52 is preferably slightly deformable so that a center portion 58 of the thread 56 can be outwardly deformed by the threads 42 on the end of handle 32 to provide a tight frictional fit. The outer cylindrical surface 48 is coated with an adhesive or other bonding agent 60. An abrasive layer 62 formed from a graded particulate material of substantially uniform size is bonded to surface 48 by the bonding agent 60.

The average particle size of the particular abrasive can be varied as necessary to form removable elements of varying abrasive character, for example, coarse, medium, fine, and very fine. Preferably, the various standard grades of abrasive are mounted on replaceable elements having bodies 52 formed of plastic of selected colors visible at least on end face 50 to coordinate the color of the replaceable element with the average size of the particulate abrasive.

The end face 50 is shown to be inclined at about a 45° angle with respect to the axis "X" of the replaceable element 38. This angle can be varied, but preferably falls within about 15° to 45°. The end face 50 is free of any abrasive so as to avoid any abrasive contact with the end of the finger.

While the present invention has been described in relation to the illustrated embodiment, various changes, modifications and additions may be made without departing from the spirit and scope of this invention as defined by the following claims.

I claim:

1. A manicuring device comprising an elongated handle, a replaceable element removably situated on at least one end of the handle, coupling means coupling the replaceable element to the handle for inhibiting rotation of the replaceable element relative to the handle, the replaceable element having a generally cylindrical outer surface incorporating an abrasive and a diagonal end surface substantially free of any abrasive.

2. The manicuring device of claim 1 wherein the elongated handle includes in at least one region having surface feature means for enhancing applicable torque to the handle.

3. The manicuring device of claim 1 wherein the elongated handle has a diameter of between 3 mm and 3 cm.

4. The manicuring device of claim 3 wherein the elongated handle has a diameter of about 1 cm.

5. The manicuring device of claim 1 wherein the coupling means comprises a plurality of elongated grooves incorporated into a surface of said at least one end of the handle, the elongated grooves engaging an inner surface of the replaceable element.

6. The manicuring device of claim 1 wherein the replaceable element has a diameter of about equal to the diameter of the handle.

7. The manicuring device of claim 1 wherein the replaceable element cylindrical outer surface comprises a cylindrical substrate, a graded particulate abrasive of substantially uniform particle size, and an adhesive bonding the particulate abrasive to the substrate.

8. The manicuring device of claim 7 wherein the replaceable element comprises a molded plastic having a color selected to indicate the particle size of the graded particulate abrasive adhesively bonded thereto.

9. The manicuring device of claim 1 wherein the diagonal end surface is inclined at an angle of between about 30° and 60° relative to an axis of rotation of the cylindrical surface of the replaceable element.

10. A replaceable element for use with a manicuring device comprising an elongated handle having coupling means for coupling the replaceable element to the handle to inhibit rotation of the replaceable element relative to the handle, the replaceable element comprising a body having an inner surface for engaging the coupling means, a generally cylindrical outer surface incorporating an abrasive, and a diagonal end surface substantially free of any abrasive.

11. The replaceable element of claim 10 wherein the inner surface includes a plurality of integral elongated grooves adapted for engagement with said coupling means.

12. The replaceable element of claim 10 wherein the cylindrical outer surface comprises a cylindrical substrate, a graded particulate abrasive of substantially uniform particle size, and an adhesive bonding the particulate abrasive to the substrate.

13. The replaceable element of claim 12 wherein the replaceable element comprises a molded plastic having a color selected to indicate the particle size of the graded particulate abrasive adhesively bonded thereto.

14. The replaceable element of claim 10 wherein the diagonal end surface is inclined at an angle of between about 15° and 45° relative to an axis of rotation of said cylindrical surface.

15. A manicuring device comprising an elongated handle having a longitudinal axis, a replaceable element co-axially and removably situated on at least one end of the handle, coupling means coupling each replaceable element to the handle for preventing rotation of each replaceable element relative to the handle, each replaceable element comprising a body having an inner surface for engaging the coupling means, a generally cylindrical outer surface incorporating an abrasive, and a diagonal end surface substantially free of any abrasive.

16. The manicuring device of claim 15 wherein the elongated handle has a diameter of between about 3 mm and 3 cm and includes in at least one region having surface feature means for enhancing torque applicable to the handle, and wherein each replaceable element has a diameter of about equal to the diameter of the handle.

17. The manicuring device of claim 15 wherein each replaceable element cylindrical surface comprises a cylindrical substrate, a graded particulate abrasive of substantially uniform particle size, and an adhesive bonding the particulate abrasive to the substrate, and wherein each replaceable element body comprises a molded plastic having a color selected to indicate the particle size of the graded particulate abrasive adhesively bonded thereto.

18. The manicuring device of claim 15 wherein the diagonal end surface of each replaceable element is inclined at an angle of between about 15° and 45° relative to the longitudinal axis of the handle.

* * * * *